US011187016B2

(12) United States Patent
Seo et al.

(10) Patent No.: US 11,187,016 B2
(45) Date of Patent: Nov. 30, 2021

(54) POWER CHILD LOCK OPERATING DEVICE

(71) Applicants: Hyundai Motor Company, Seoul (KR); Kia Motors Corporation, Seoul (KR)

(72) Inventors: Yongdae Seo, Seoul (KR); Jinwoo Nam, Seoul (KR); Jinsang Chung, Hwaseong-si (KR); Dong Wuk Choi, Yongin-si (KR); Jae Hyun Seok, Suwon-si (KR); Seong Geun Byeon, Daegu (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 598 days.

(21) Appl. No.: 16/151,218

(22) Filed: Oct. 3, 2018

(65) Prior Publication Data

US 2019/0234115 A1 Aug. 1, 2019

(30) Foreign Application Priority Data

Jan. 30, 2018 (KR) ..... 10-2018-0011636

(51) Int. Cl.
*E05B 77/26* (2014.01)
*E05B 81/06* (2014.01)
(Continued)

(52) U.S. Cl.
CPC ..... *E05B 77/26* (2013.01); *E05B 77/32* (2013.01); *E05B 81/06* (2013.01); *E05B 81/16* (2013.01);
(Continued)

(58) Field of Classification Search
CPC ..... E05B 77/26; E05B 81/16; E05B 81/25; E05B 81/30; E05B 81/06; E05B 81/36; E05B 77/24; E05B 77/245; E05B 77/30
(Continued)

(56) References Cited

U.S. PATENT DOCUMENTS 6,631,932 B2 * 10/2003 Kunst ..... E05B 77/26 292/201
8,388,030 B2 * 3/2013 Takahashi ..... E05B 81/34 292/201
(Continued)

FOREIGN PATENT DOCUMENTS

CN 106401324 A * 2/2017
CN 106401324 A 2/2017
(Continued)

OTHER PUBLICATIONS

European Search Report dated May 13, 2019 for European Patent Application No. 18199263.7.
(Continued)

*Primary Examiner* — Kristina R Fulton
*Assistant Examiner* — Emily G. Brown
(74) *Attorney, Agent, or Firm* — Morgan, Lewis & Bockius LLP

(57) ABSTRACT

A power child lock operating device may include a rotating drive device; a first operating lever which receives the torque of the rotating drive device to be rotated; a second operating lever connected to the first operating lever to be moved together; a third operating lever connected to a door catch to lock or unlock the door catch; an inside handle lever connected to an inside handle disposed at a door of a vehicle to be moved together; a fourth operating lever selectively connecting the inside handle lever and the third operating lever; and an elastic member pressurizing to the fourth
(Continued)

operating lever so that the third operating lever may be connected to the inside handle lever, improving the operation reliability the power child lock device.

9 Claims, 8 Drawing Sheets

(51) Int. Cl.

| | |
|---|---|
| ***E05B 81/36*** | (2014.01) |
| ***E05B 81/16*** | (2014.01) |
| ***E05B 81/24*** | (2014.01) |
| ***E05B 77/32*** | (2014.01) |
| ***E05B 81/30*** | (2014.01) |

(52) U.S. Cl.
CPC ..... *E05B 81/25* (2013.01); *E05B 81/30* (2013.01); *E05B 81/36* (2013.01)

(58) Field of Classification Search
USPC ..... 292/201
See application file for complete search history.

(56) References Cited

U.S. PATENT DOCUMENTS

| | | | | |
|---|---|---|---|---|
| 8,740,264 | B2 * | 6/2014 | Akizuki | E05B 81/16 292/201 |
| 10,641,016 | B2 * | 5/2020 | Damboiu | E05B 77/06 |
| 2001/0030428 | A1 | 10/2001 | Kunst et al. | |
| 2012/0074719 | A1 * | 3/2012 | Nagaoka | E05B 77/265 292/336.3 |
| 2019/0136586 | A1 * | 5/2019 | Han | E05B 79/20 |

FOREIGN PATENT DOCUMENTS

| | | | |
|---|---|---|---|
| CN | 106996227 | A | 8/2017 |
| JP | 58-034941 | Y2 | 8/1983 |
| KR | 10-2012-0094382 | A | 8/2012 |
| KR | 10-1513000 | B1 | 4/2015 |
| KR | 101513000 | B1 * | 4/2015 |

OTHER PUBLICATIONS

Chinese Office Action dated Dec. 28, 2020 for Chinese Patent Application No. 201811284705.5.

* cited by examiner

POWER CHILD LOCK OPERATING DEVICE

CROSS-REFERENCE TO RELATED APPLICATION

The present application claims priority to Korean Patent Application No. 10-2018-0011636 filed on Jan. 30, 2018, the entire contents of which is incorporated herein for all purposes by this reference.

BACKGROUND OF THE INVENTION

Field of the Invention

The present invention relates to a power child lock operating device. More particularly, the present invention relates to a power child lock operating device capable of smoothly locking and releasing a child lock provided in a rear door of a vehicle by a driver's switch operation.

Description of Related Art

In the conventional seat of the vehicle, an inside handle for opening the door is provided. Particularly in the rear seat, a child lock device is provided to prevent a child from arbitrarily opening the door.

The child lock device is provided in a form of a knob on the inside handle so that the occupant can manually operate the knob to lock or unlock the child lock device.

In recent years, a so-called power child lock device, in which a driver locks or unlocks a child lock device by a switch operation, is universally disposed to improve convenience.

A conventional power child lock device may include, a drive motor for receiving a power according to a switch operation of a driver to be operated, a worm as a drive gear provided in the drive motor, a first operating lever having a worm gear engaged with the worm, a second actuating lever having one end portion connected to the first operating lever to be integrally rotated, an unlock lever coupled to the second operating lever and connected to the door lock device, an inside handle lever connected to a door inside handle to be moved together, and a power child lock switch which is manipulated by a driver to release or lock the power child lock device, and the like.

Therefore, when the driver operates the power child lock switch in the release direction thereof, the drive motor is supplied with power, the drive motor rotates in one direction thereof, and the drive motor rotates the worm mounted at the drive motor simultaneously. The worm gear rotates the first operating lever in a clockwise direction through the worm and the second operating lever rotates clockwise by the rotation of the first operating lever to pull the unlock lever so that a power child lock device is released and the door is configured to be opened.

However, if an occupant in the rear seat rotates the inside handle to open the door with a power child lock device locked and a driver simultaneously operates the power child lock switch in the release direction to release the power child lock device, the inside handle lever and the first operating lever are simultaneously operated to generate interference, so that the inside handle lever cannot return to the original position due to the interference of the first operating lever, or the releasing operation of the power child lock device is impossible, and the like.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a power child lock operating device that can operate smoothly without interfering between components even if the rear door opening or closing operation of the vehicle occupant and the rear door opening operation of the driver are performed simultaneously.

A power child lock operating device according to an exemplary embodiment of the present invention may include a rotating drive device; a first operating lever which receives the torque of the rotating drive device to be rotated; a second operating lever connected to the first operating lever to be moved together; a third operating lever connected to a door catch to lock or unlock the door catch; an inside handle lever connected to an inside handle disposed at a door of a vehicle to be moved together; a fourth operating lever selectively connecting the inside handle lever and the third operating lever; and an elastic member pressurizing to the fourth operating lever so that the third operating lever may be connected to the inside handle lever.

The rotating drive device may be a drive motor configured for rotating in the clockwise and anticlockwise A worm may be formed at the drive motor to be integrally rotated and a worm gear engaged with the worm may be provided in the second operating lever.

The worm gear may be formed at one end portion of the first operating lever, a protrusion may be provided in the other end portion of the first operating lever; and a shaft hole, into which a pin is inserted so that the first operating lever can rotate, may be formed between the one end portion and the other end portion of the first operating lever to be penetrated.

A hook having an accommodating groove that wraps around and hangs the protrusion of the first operating lever may be provided in one end portion the second operating lever.

A protrusion inserted into the fourth operating lever to be hanged is provided in the other end portion of the second operating lever.

A slot may be formed between the one end portion and the other end portion of the second operating lever and an assemble pin may be inserted into the slot.

The elastic member may include a pressurizing spring having one end portion and the other end portion and being disposed at the fourth operating lever.

The third operating lever may include a first hole into which the assemble pin is inserted, a second hole to which the fourth operating lever is fitted to be assembled thereto, a coupling groove which the fourth operating lever is inserted into to be coupled thereto or separated therefrom, and a hanging jaw which the one end portion of the pressurizing spring is hanged to be supported thereby.

The fourth operating lever may include a first boss which the pressurizing spring is wound around and supported by and a second boss having an accommodating groove into which the protrusion of the second operating lever is inserted to be moved, and the other end portion of the pressurizing spring may be supported on the external wall of the second boss.

The fourth operating lever may further include an assemble protrusion which penetrates through the second hole of the third operating lever to be assembled, and a coupling protrusion inserted into a coupling hole of the third operating lever to be connected to the third operating lever or separated from the coupling hole of the third operating lever.

The inside handle lever may include a first hole into which the assemble pin is inserted to be assembled, a second hole into which a cable is inserted to be hanged thereto to connect with an inside handle disposed at a door of a vehicle through the cable, and a coupling groove to which the fourth operating lever is coupled to be connected thereto or separated therefrom.

In accordance with a power child lock operating device according to an exemplary embodiment of the present invention, a plurality of operating levers is smoothly operated without generating interference to each other so that the operating reliability may be improved, component damage or breakage due to interference of components may be effectively prevented, improving the merchantability of the vehicle.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
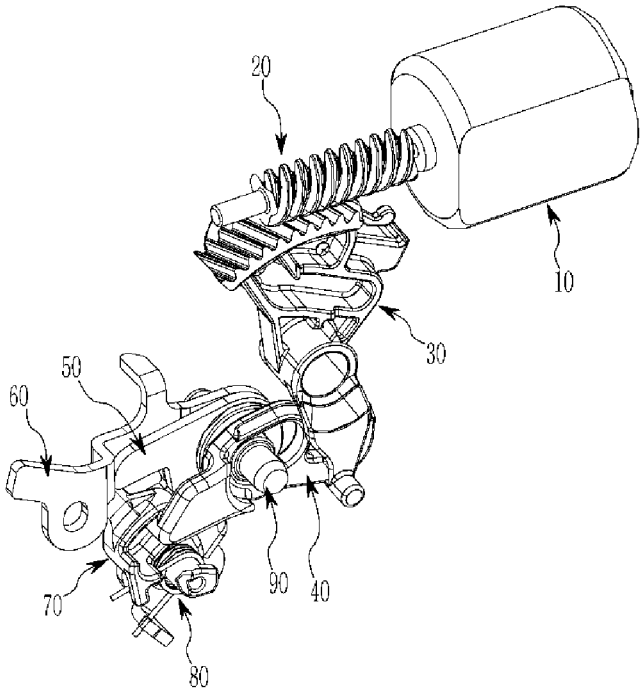
FIG. 1 is a perspective view of a power child lock operating device according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, an exemplary embodiment of the present invention will be described in detail with reference to accompanying drawings.

Figure 2:
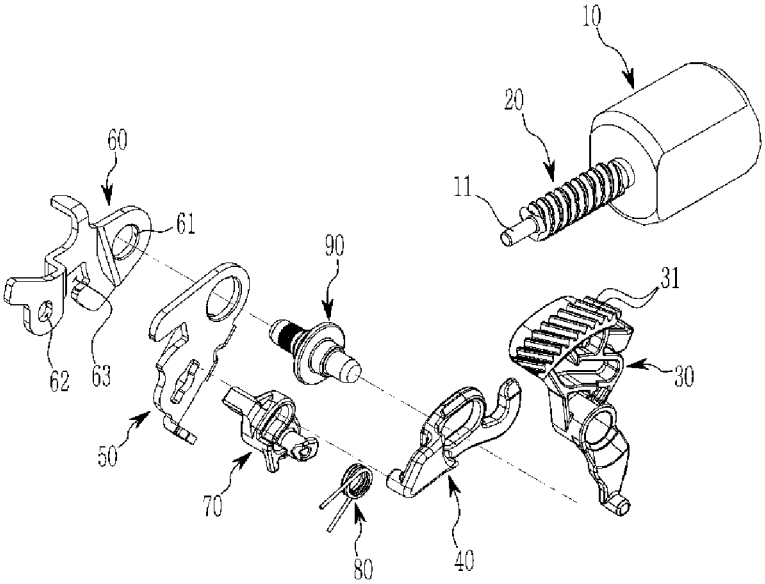
FIG. 2 is an exploded perspective view of the power child lock operating device according to an exemplary embodiment of the present invention.

Referring to FIG. 1 and FIG. 2, a power child lock operating device according to an exemplary embodiment of the present invention may include a drive motor 10 as a rotating drive device configured for rotating in a clockwise and anticlockwise manner, a worm 20 formed at a motor shaft 11 of the drive motor 10, a first operating lever 30 having a worm gear 31 engaged with the worm 20, a second operating lever 40 connected to the first operating lever 30 to be moved together, a third operating lever 50 connected to a door catch to lock or unlock the door catch, an interlocking connection with the inside handle provided on the vehicle door, an inside handle lever 60 connected to an inside handle disposed at the door of a vehicle, a fourth operating lever 70 for selectively connecting the handle lever 60 and the third operating lever, and a pressurizing spring 80 as an elastic member provided on the fourth operating lever for applying an elastic force to the fourth operating lever.

Figure 3:
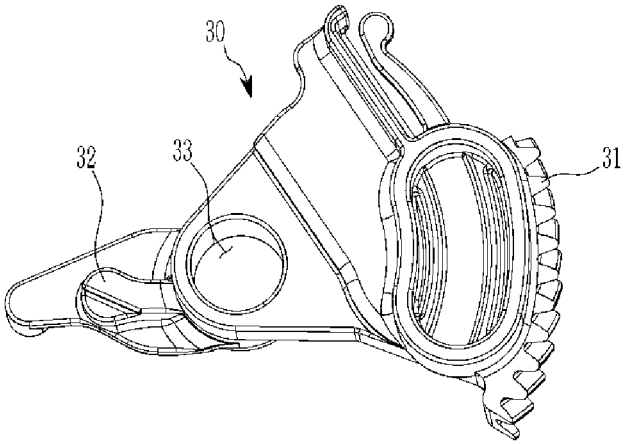
FIG. 3 is a perspective view of the first operating lever of a power child lock operating device according to an exemplary embodiment of the present invention.
Figure 4:
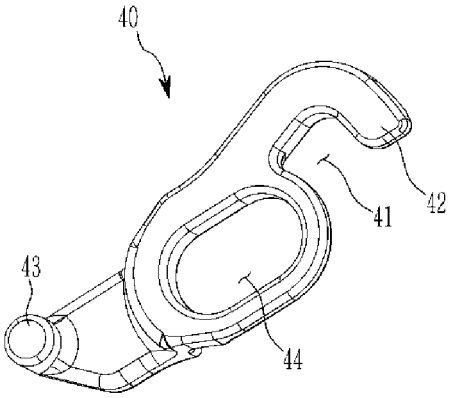
FIG. 4 is a perspective view of the second operating lever of a power child lock operating device according to an exemplary embodiment of the present invention.
Figure 5:
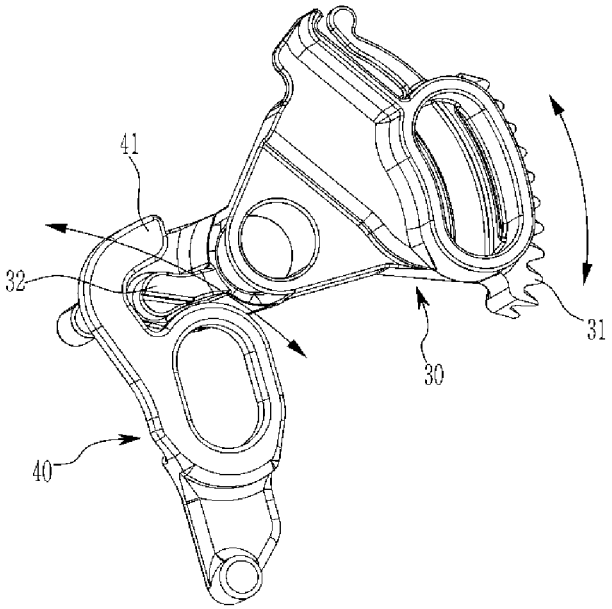
FIG. 5 is a perspective view of the combination of the second operating lever and the third operating lever of a power child lock operating device according to an exemplary embodiment of the present invention.

Referring FIG. 3, FIG. 4, and FIG. 5, the worm gear 31 may be formed in a circular arc shape at one end portion of the first operating lever 30, the other end portion of the first operating lever 30 may be provided with a protrusion 32, and a shaft hole 33 into which a pin is inserted may be formed between the one end portion and the other end portion so that the first operating lever 30 can rotate.

A hook 42 having an accommodating groove 41 that wraps around and hangs the protrusion 32 of the first operating lever 30 may be formed at one end portion of the second operating lever 40.

The hook 42 may be formed in a substantial "U"-shape. Therefore, when the first operating lever 30 is rotated around its shaft hole 33 by drive of the drive motor 10, the second operating lever 40 is pulled or pushed by the first operating lever 30 due to the interaction of the hook 42 and the protrusion 32.

A protrusion 43, which is inserted into and hanged by the fourth operating lever 70, may be provided in the other end portion of the second operating lever 40, a slot 44 may be formed between the one end portion and the other end portion of the second operating lever 40, and an assemble pin 90 shown in FIG. 2 may be inserted into the slot 44 so that the assemble pin 90 can move in the slot 44.

Figure 6:
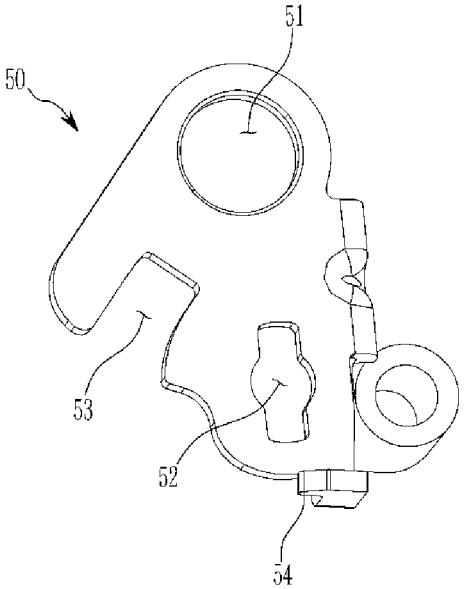
FIG. 6 is a perspective view of the third operating lever of a power child lock operating device according to an exemplary embodiment of the present invention.
Figure 7:
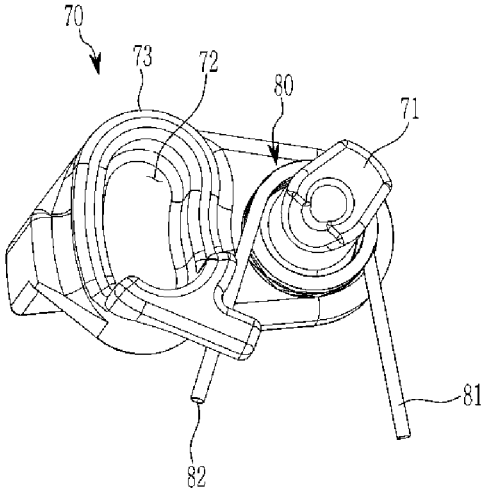
FIG. 7 is a perspective view of the fourth operating lever of a power child lock operating device according to an exemplary embodiment of the present invention.
Figure 8:
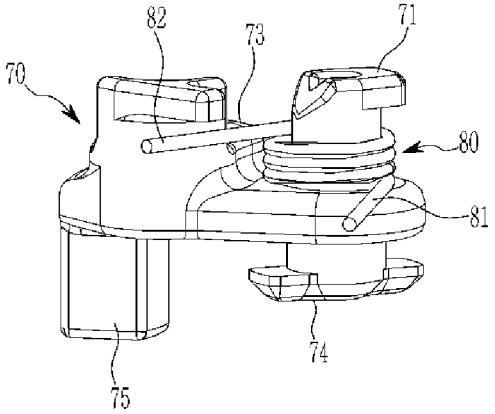
FIG. 8 is a side view of the fourth operating lever according to an exemplary embodiment of the present invention.
Figure 9:
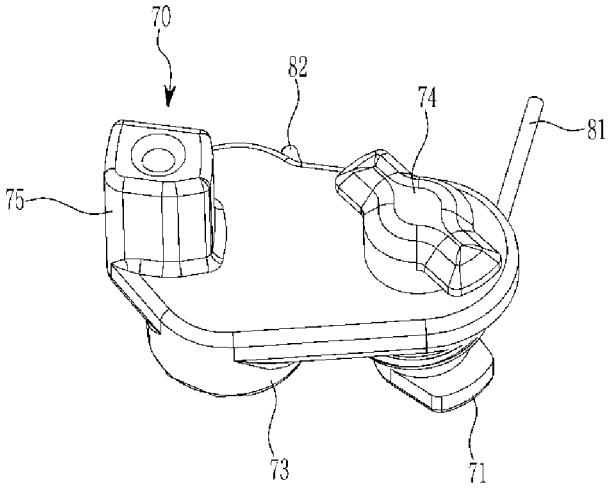
FIG. 9 is a perspective view of the fourth operating lever of a power child lock operating device according to an exemplary embodiment of the present invention.
Figure 10:
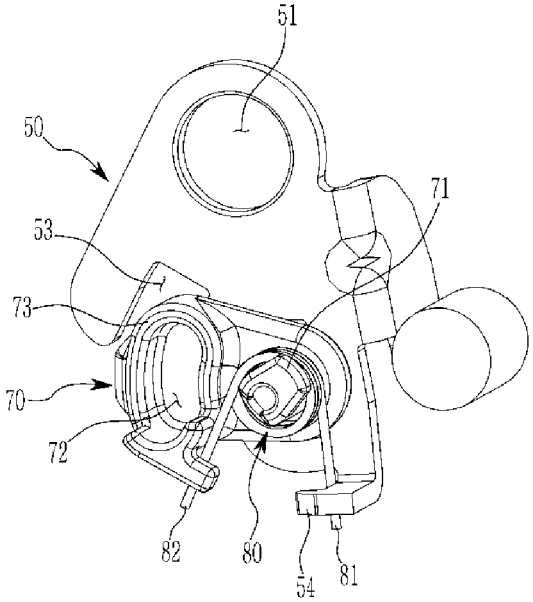
FIG. 10 is a bottom perspective view of the combination of the third operating lever and the fourth operating lever of a power child lock operating device according to an exemplary embodiment of the present invention.
Figure 11:
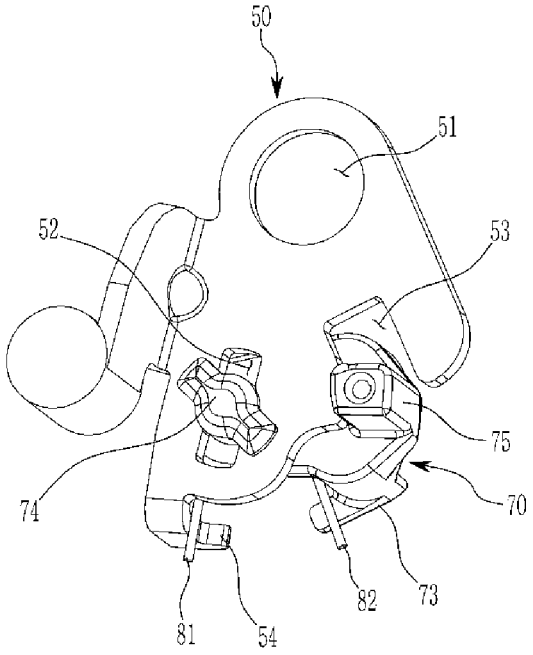
FIG. 11 is a perspective view in the back direction of FIG. 10.

Referring to FIG. 6, the third operating lever 50 may include a first hole 51 into which the assemble pin 90 is inserted, a second hole 52 which the fourth operating lever 70 is inserted into and assembled thereto, a coupling groove 53 which the fourth operating lever is inserted into to be coupled thereto or separated therefrom, and a hanging jaw 54 which one end portion 81 of the pressurizing spring 80 (refer to FIG. 7 and FIG. 8) is hanged to be supported by.

Referring to FIG. 7 to FIG. 11, the fourth operating lever 70 may include a first boss 71 which the pressurizing spring 80 is wound around and supported by, and a second boss 73 having an accommodating groove 72 into which the protrusion 43 of the second operating lever 40 is inserted to be moved.

The other end portion 82 of the pressurizing spring 80 is supported on the external wall of the second boss 73, so that the pressurizing spring 80 applies a pressing elastic force to the fourth operating lever 70.

Furthermore, the fourth operating lever 70 may further include an assemble protrusion 74 in a substantial "T"-shape penetrating the second hole 52 of the third operating lever 50 to be assembled thereto, and a coupling protrusion 75 inserted into the coupling groove 53 of the third operating lever 50 to be connected to the third operating lever 50 or separated from the coupling groove 53 of the third operating lever 50 to be disconnected.

Referring to FIG. 1 and FIG. 2 again, the inside handle lever 60 may include a first hole 61 which the assemble pin 90 is inserted into and assembled to, a second hole 62 into which a cable is insert to be hanged to connect with the inside handle disposed at the door of the vehicle through the cable vehicle, and a coupling groove 63 to which the fourth operating lever 70 is coupled to be connected or separated from.

Referring to FIG. 12, FIG. 13, FIG. 14 and FIG. 15, the operation of the power child lock operating device according to an exemplary embodiment of the present invention will be described.

Figure 12:
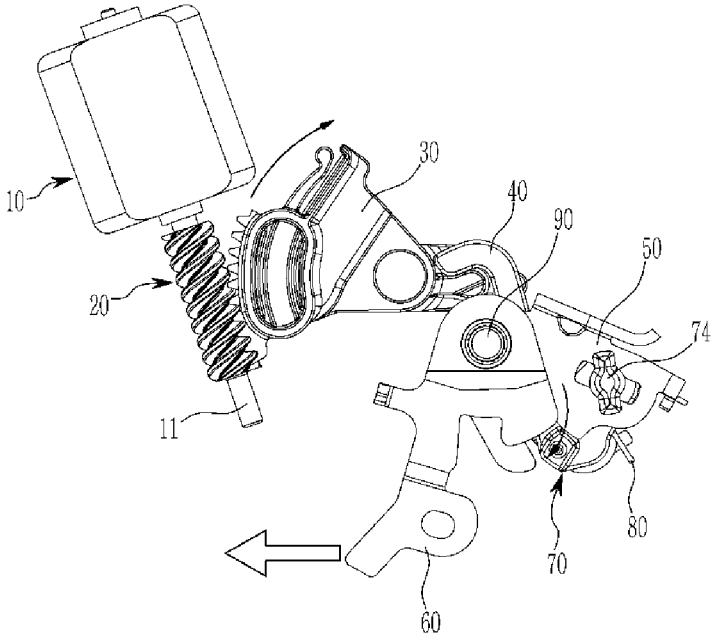
FIG. 12, FIG. 13, FIG. 14, and FIG. 15 are an explanatory diagram of a power child lock operating device according to an exemplary embodiment of the present invention.

First, FIG. 12 shows a power child lock operating device locked and a door locked.

In the instant state, when the rear passenger pulls the door inside handle as shown in the arrow to open the door of the vehicle and, only the inside handle lever 60 connected to the door inside handle through the cable rotates around the assemble pin 90, and since the inside handle lever 60 and the third operating lever 50 are not connected to each other, so that the third operating lever 50 remain its position and the rear door is not opened.

Figure 13:
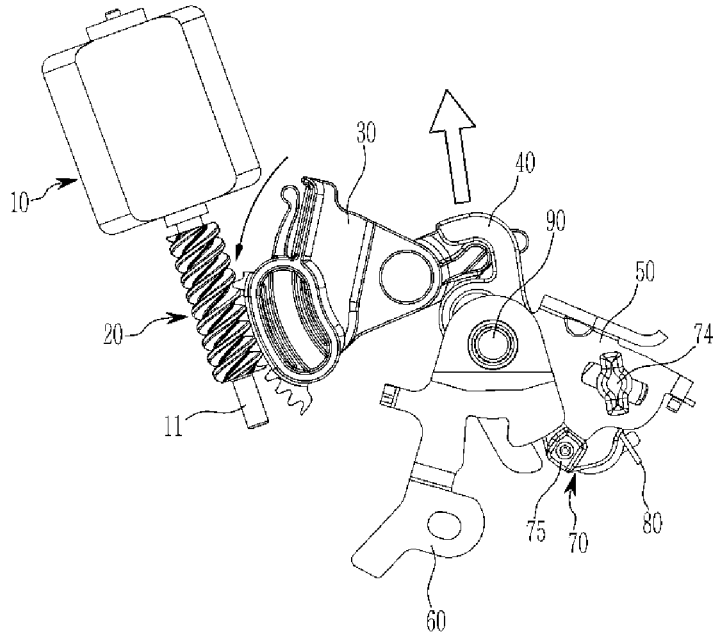

When the driver operates the power child lock switch to switch on in order to open the rear door according to the intention of the passenger in the rear seat, as shown in FIG. 13, drive motor 10 rotates the worm 20 and the worm gear 31 is rotated by the rotation of the worm 20 so that the first operating lever 30 rotates in the anticlockwise direction around the shaft hole 33.

The second operating lever 40 connected to the first operating lever 30 through the first hook 42 rises by the rotation of the first operating lever 30, but the assemble pin 90 is in the slot 44 of the second operating lever 40, so that the inside handle lever 60 assembled to the assemble pin 90, the third operating lever 50 and the fourth operating lever 70 remain in original positions.

Figure 14:
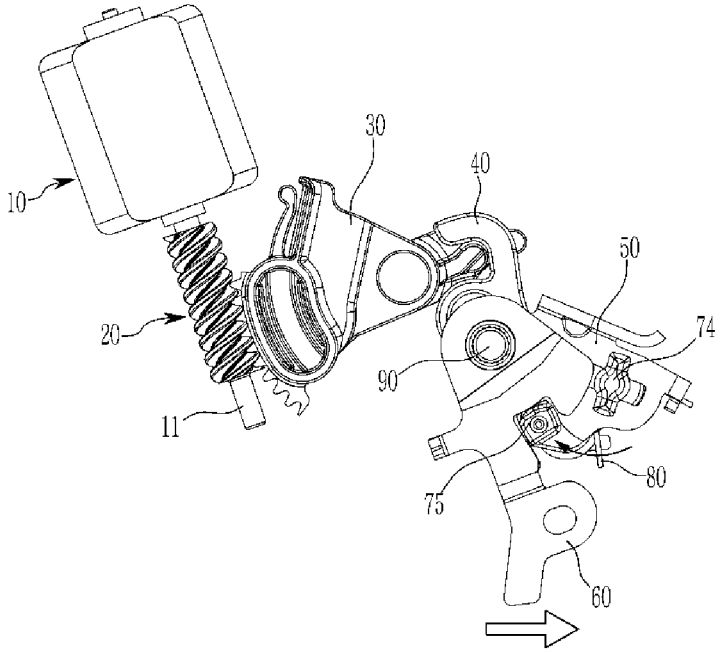
Figure 15:
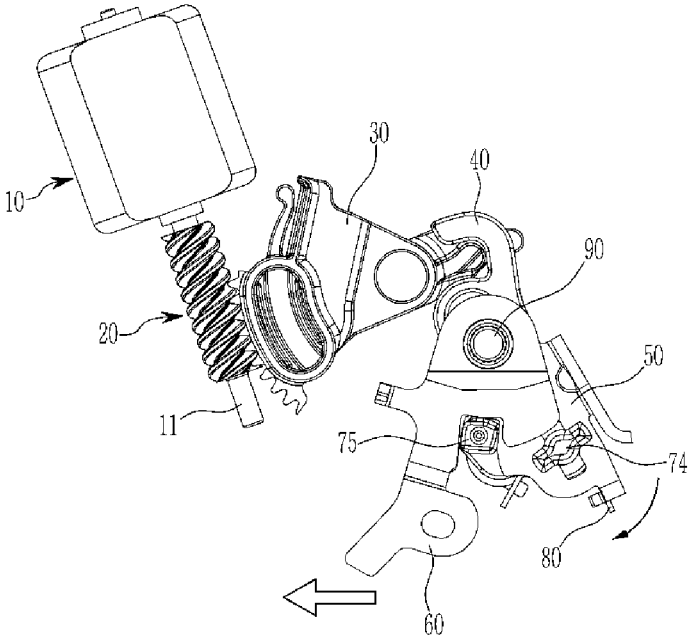

If the driver switches the power child lock off and the rear seat occupant releases the door inside handle again, as shown in FIG. 14, the inside handle lever 60 is returned to its original position and the coupling protrusion 75 of the fourth operating lever 70 is inserted into the coupling groove 63 of the inside handle lever 60 by the elastic force of the pressurizing spring 80, so that the third operating lever 50 and the fourth operating lever 70 are integrally connected together.

In the instant state, the rear seat occupant pulls the inside handle lever 60 to pull the door inside handle again to open the rear door, the inside handle lever 60 is rotated about the assemble pin 90 so that the third operating lever 50 and the fourth operating lever 70 are rotated together and the third operating lever 50 is also pulled to release the door catch of the rear door, opening the rear door.

This series of smooth operation prevents the interference between the levers which occurred in the related art, and improves the operational reliability and also effectively prevents damage or breakage of the parts.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A power child lock operating device comprising:

a rotating drive device;

a first operating lever which receives torque from the rotating drive device to be rotated;

a second operating lever coupled to the first operating lever to be moved with the first operating lever;

a third operating lever coupled to the second operating lever and configured to be connected to a door catch to lock or unlock the door catch;

an inside handle lever configured to be connected to an inside handle disposed at a door of a vehicle to be moved with the inside handle;

a fourth operating lever coupled to the second operating lever and selectively connecting the inside handle lever and the third operating lever; and an elastic member coupled to the third operating lever and the fourth operating lever and biasing in a predetermined direction so that the third operating lever is configured to be connected to the inside handle lever, wherein the rotating drive device is a drive motor configured for rotating in a first direction or a second direction, wherein a worm is formed at a motor shaft of the drive motor, wherein a worm gear engaged with the worm is provided in the first operating lever, wherein the worm gear is formed at a first end portion of the first operating lever, wherein a first protrusion is provided in a second end portion of the first operating lever, wherein a shaft hole, into which a pin is inserted so that the first operating lever is configured to rotate with respect to the pin, is formed between the first end portion and the second end portion of the first operating lever, and wherein a hook having an accommodating groove that wraps around and couples the first protrusion of the first operating lever is provided in a first end portion of the second operating lever.

2. The power child lock operating device of claim 1, wherein a second protrusion coupled to the fourth operating lever is provided in a second end portion of the second operating lever;

wherein a slot is formed between the first end portion and the second end portion of the second operating lever; and wherein an assemble pin is inserted into the slot to couple the second and third operating levers and the inside handle lever.

3. The power child lock operating device of claim 2, wherein the elastic member includes a spring having a first end portion coupled to the third operating lever and a second end portion coupled to the fourth operating lever.

4. The power child lock operating device of claim 3, wherein the third operating lever includes:

a first hole into which the assemble pin is inserted;

a second hole to which a first portion of the fourth operating lever is mounted;

a first coupling groove which a second portion of the fourth operating lever is selectively coupled; and a hanging jaw to which the first end portion of the spring is mounted to be supported by the hanging jaw.

5. The power child lock operating device of claim 4, wherein the fourth operating lever includes:

a first boss which the spring is wound around and supported by; and a second boss having an accommodating groove into which the second protrusion of the second operating lever is rotatably inserted.

6. The power child lock operating device of claim 5, wherein the second end portion of the spring is supported on an external wall of the second boss.

7. The power child lock operating device of claim 5, wherein the fourth operating lever further includes:

a third protrusion which penetrates through the second hole of the third operating lever to be mounted thereto; and a coupling protrusion selectively coupled into the first coupling groove of the third operating lever to be connected to the third operating lever or separated from the third operating lever.

8. The power child lock operating device of claim 7, wherein the inside handle lever includes:

a third hole into which the assemble pin is mounted; and a second coupling groove to which the second portion of the fourth operating lever is selectively coupled.

9. The power child lock operating device of claim 8, wherein the inside handle lever further includes a fourth hole into which a cable is mounted so as to connect with the inside handle disposed at the door of the vehicle through the cable.

* * * * *